US011854378B1

(12) United States Patent
Shuss

(10) Patent No.: US 11,854,378 B1
(45) Date of Patent: Dec. 26, 2023

(54) EVENT INDICATING LIGHT ASSEMBLY AND METHOD

(71) Applicant: Eric Shuss, Orange, CA (US)

(72) Inventor: Eric Shuss, Orange, CA (US)

( * ) Notice: Subject to any disclaimer, the term of this patent is extended or adjusted under 35 U.S.C. 154(b) by 0 days.

(21) Appl. No.: 17/861,899

(22) Filed: Jul. 11, 2022

(51) Int. Cl.

| | |
|---|---|
| ***G09F 9/33*** | (2006.01) |
| ***G08B 5/36*** | (2006.01) |
| ***H05B 45/20*** | (2020.01) |
| ***H05B 47/19*** | (2020.01) |

(52) U.S. Cl.
CPC ..... *G08B 5/36* (2013.01); *H05B 45/20* (2020.01); *H05B 47/19* (2020.01)

(58) Field of Classification Search
USPC ..... 340/815.45, 539.21–539.22, 488, 513, 340/528, 538.11, 538.12, 545.6–545.9
See application file for complete search history.

(56) References Cited

U.S. PATENT DOCUMENTS

| | | | | |
|---|---|---|---|---|
| D255,106 | S | 5/1980 | Bodenrader | |
| 5,835,573 | A | 11/1998 | Dee | |
| 6,236,303 | B1 | 5/2001 | Wagner | |
| 6,359,564 | B1 | 3/2002 | Thacker | |
| 7,443,971 | B2 * | 10/2008 | Bear | H04M 3/436 379/215.01 |
| 8,035,519 | B2 | 10/2011 | Davis | |
| 9,137,974 | B2 * | 9/2015 | Boehm | A01K 31/007 |
| 2006/0264205 | A1 | 11/2006 | Gibbs | |
| 2016/0053982 | A1 * | 2/2016 | Kovalchick | F21V 5/04 362/249.02 |
| 2016/0138789 | A1 * | 5/2016 | Brown | F21V 23/0471 362/249.05 |
| 2018/0188018 | A1 * | 7/2018 | Brown | G01B 11/14 |

* cited by examiner

*Primary Examiner* — Daniel Previl

(57) ABSTRACT

An event indicating light assembly and method for communicating a software application with a pair of lights includes a software application being programmed on an electronic device including a mobile device and a personal computer. The software application is connected with a variety of software calendars to track a plurality of events of a user. A pair of light fixtures is in wireless communication with the electronic device. Each of the light fixtures has a plurality of light emitting diodes being a variety of colors. A microprocessor is positioned within each of the light fixtures and is connected with the plurality of light emitting diodes of each light fixture. A battery is positioned within each of the light fixtures and is in electric communication with the microprocessor and with a charging port. A mounting pad of each of the light fixtures retains the light fixture to a wall.

11 Claims, 6 Drawing Sheets

EVENT INDICATING LIGHT ASSEMBLY AND METHOD

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to availability indicating device and more particularly pertains to a new availability indicating device for communicating a software application with a pair of lights.

(2) Description of Related Art Including Information Disclosed Under 37 CFR 1.97 and 1.98

The prior art relates to availability indicating devices. The prior art relates to a variety of availability indicating devices having a light to signify when a user is busy or available. Known prior art lacks an availability indicating device configured to emit a pair of lights to signify when a user is busy or available and being in wireless communication with a software application.

(h) BRIEF SUMMARY OF THE INVENTION

An embodiment of the disclosure meets the needs presented above by generally comprising a software application is configured for being programmed on an electronic device. The electronic device includes a mobile device and a personal computer. The software application is configured for being in communication with a variety of software calendars and tracking a plurality of events of a user from the variety of software calendars. A pair of light fixtures is configured for being in wireless communication with the electronic device. Each of the light fixtures has a peripheral surface and a mounting surface, and the peripheral surface of each of the light fixtures has a plurality of light emitting diodes. Each of the light emitting diodes is configured for being a respective one of a variety of colors. A microprocessor is positioned within each of the light fixtures and is in electric communication with the plurality of light emitting diodes of each light fixture. A battery is positioned within each of the light fixtures. The battery is in electric communication with the microprocessor and with a charging port. A mounting pad of each of the light fixtures is configured for retaining to a wall.

Another embodiment of the disclosure includes a method comprising the step of programming a software application on an electronic device. The user communicates the software application with a variety of software calendars of the electronic device. In addition, the user positions a pair of light fixtures proximate to a respective one of a pair of sides of a door way. Each of the light fixtures is adhered by a mounting pad to a respective one of each of the sides of the door way. The user charges a battery of each of the light fixtures by engaging a charging cord with a charging port of each of the light fixtures. The user connects the software application of the electronic device to a transceiver of a microprocessor of each of the light fixtures by wireless communication. Subsequently, the user assigns a plurality of light emitting diodes of each of the light fixtures to a respective one of a plurality of events of the variety of software calendars using the software application.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
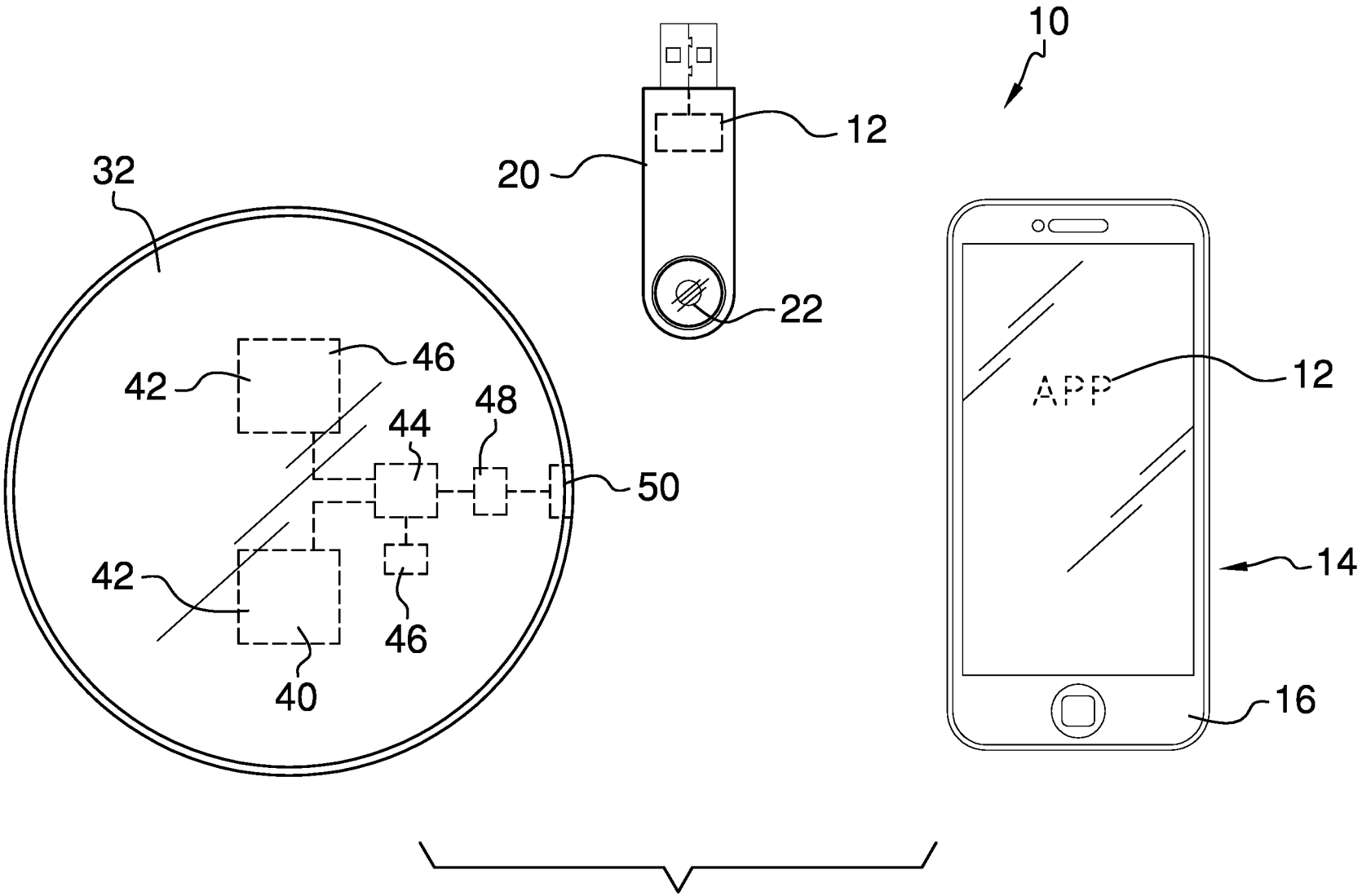
FIG. 1 is a front view of an event indicating light assembly and method according to an embodiment of the disclosure.
Figure 2:
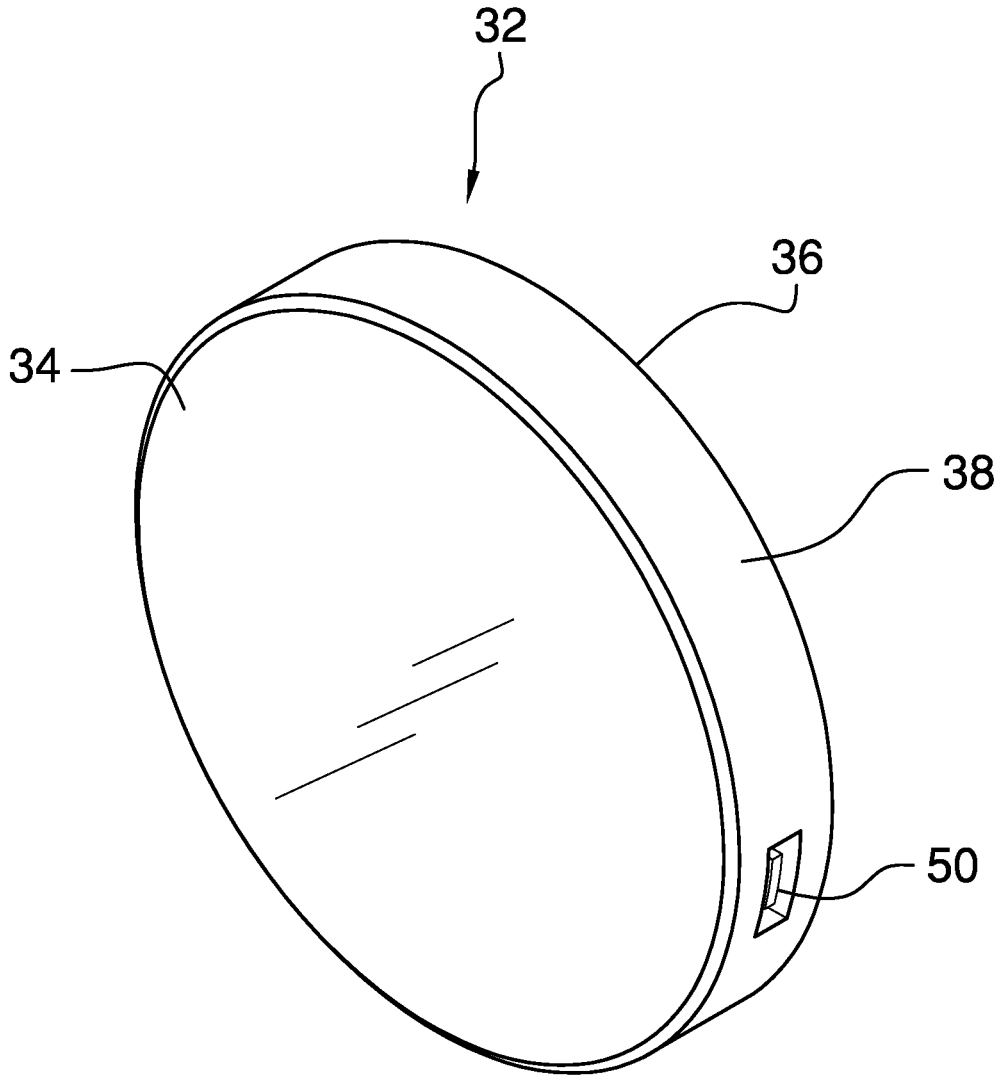
FIG. 2 is a top isometric view of an embodiment of the disclosure.
Figure 3:
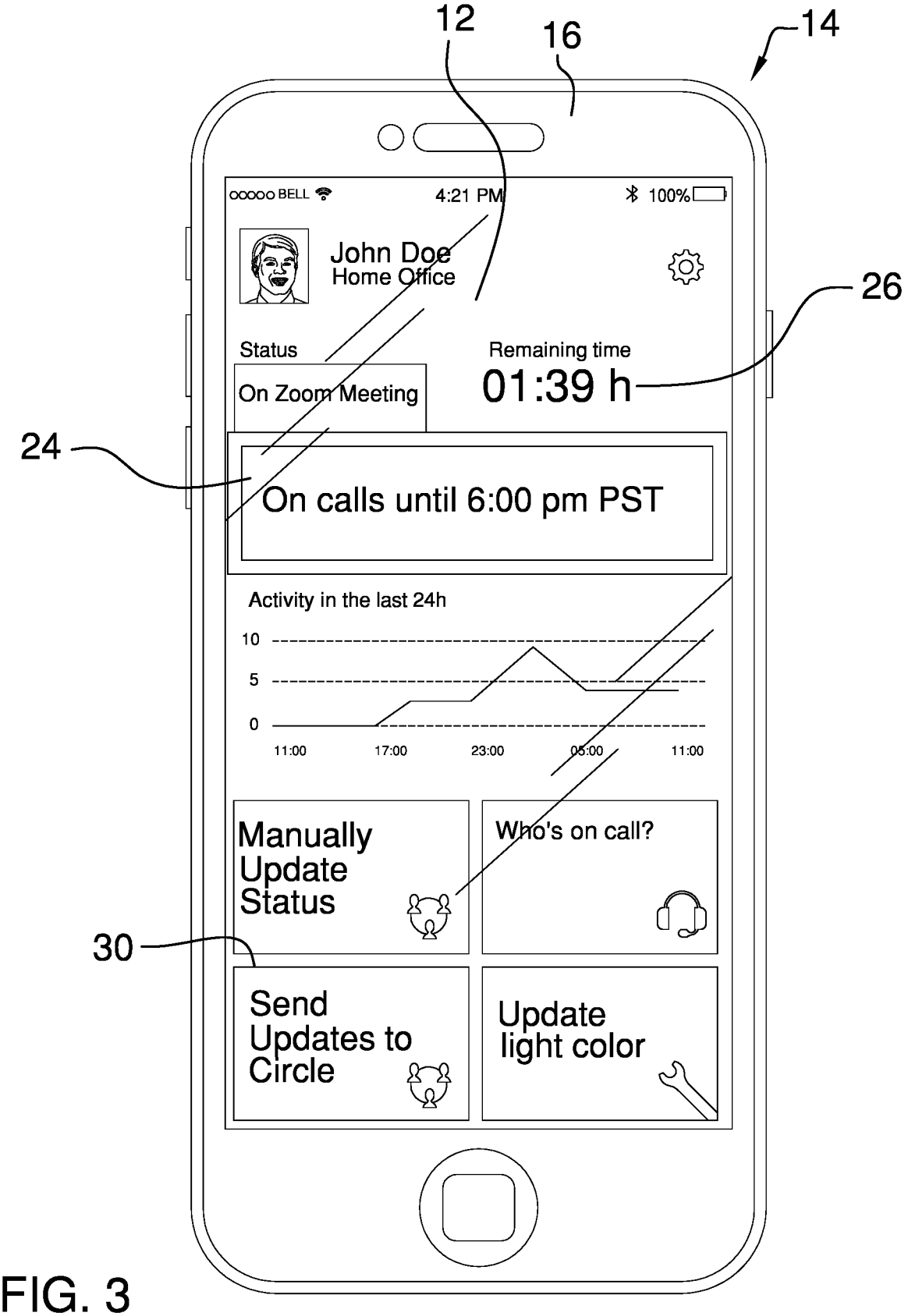
FIG. 3 is a detail view of an embodiment of the disclosure.
Figure 4:
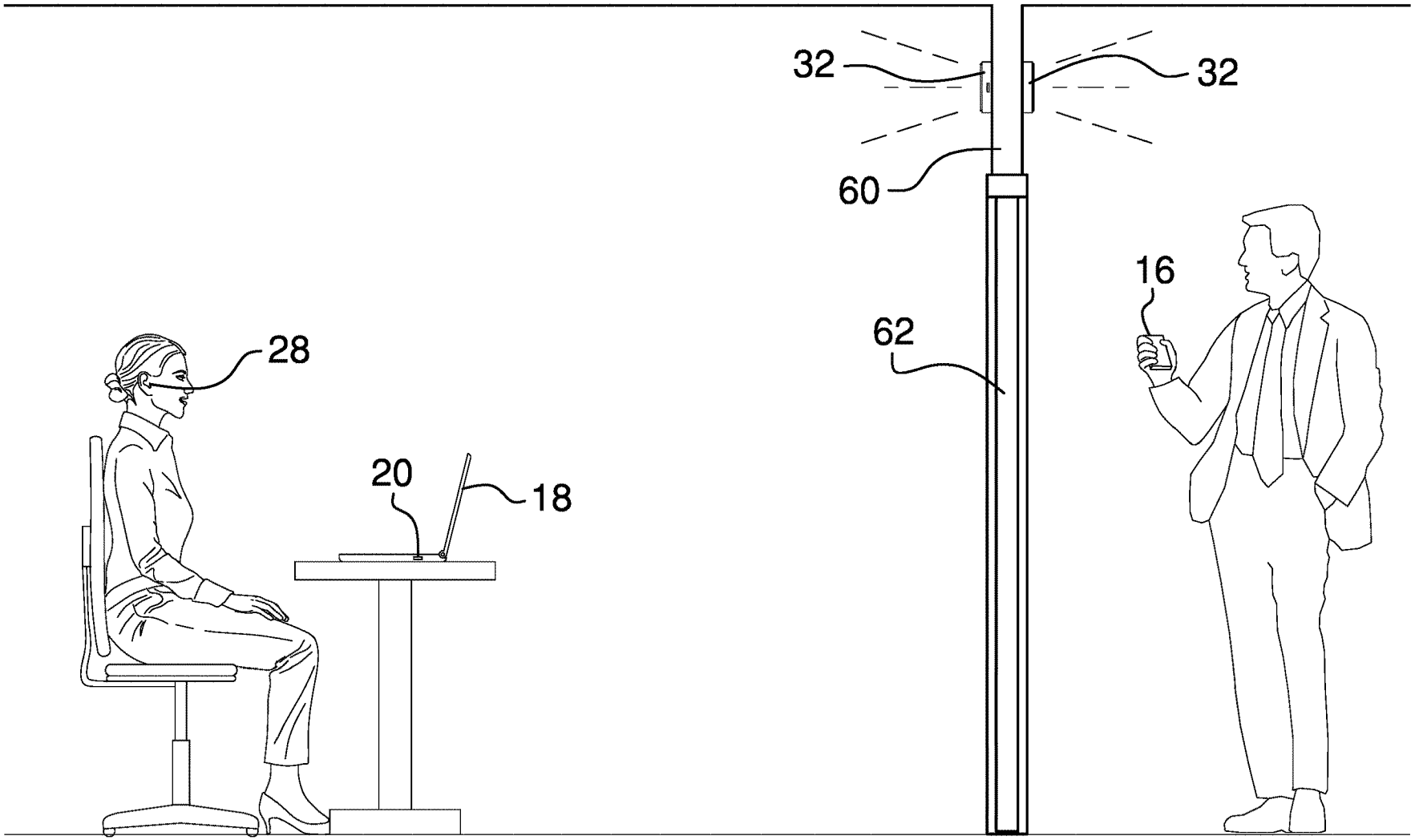
FIG. 4 is an in-use view of an embodiment of the disclosure.
Figure 5:
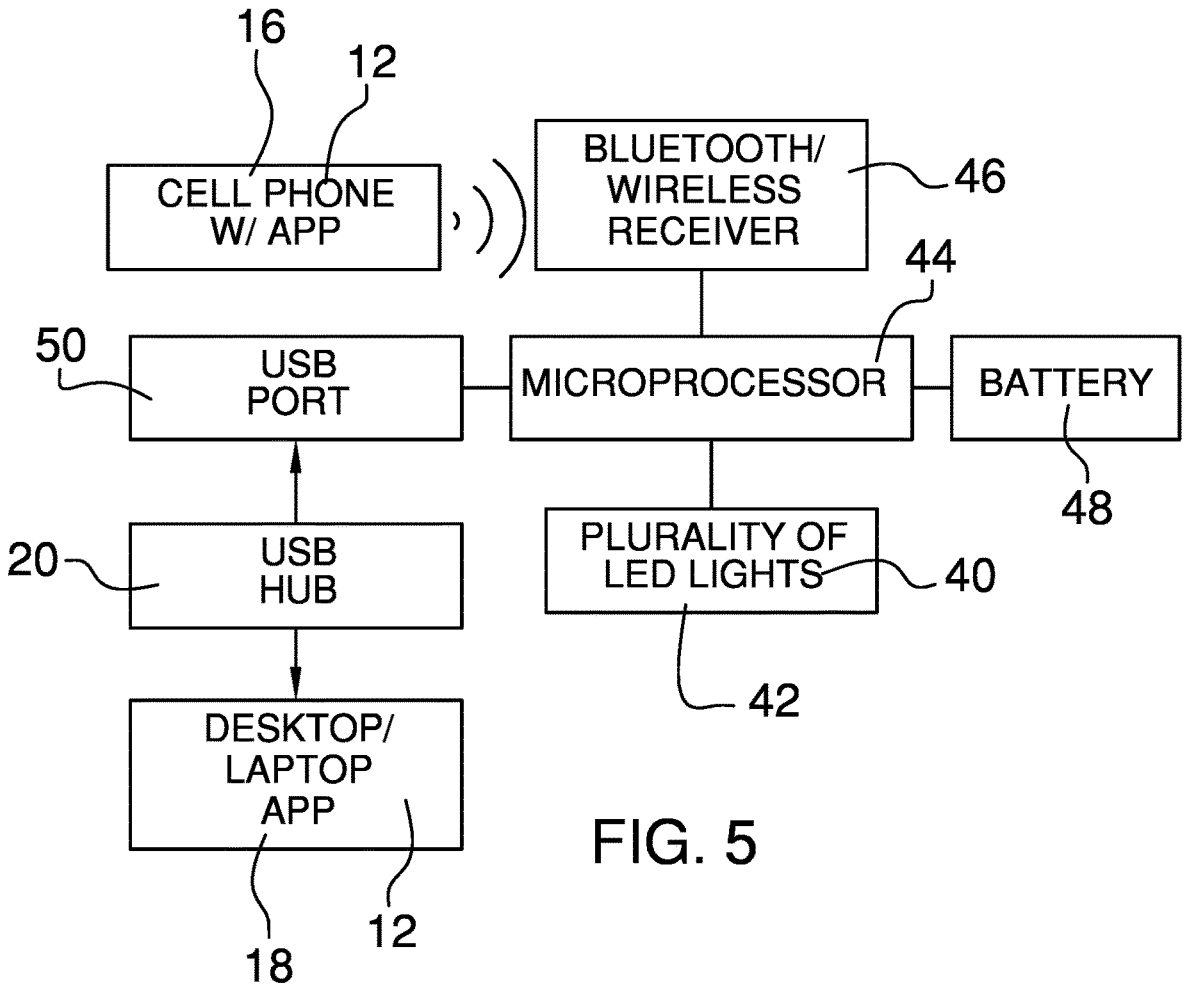
FIG. 5 is a block diagram view of an embodiment of the disclosure.
Figure 6:
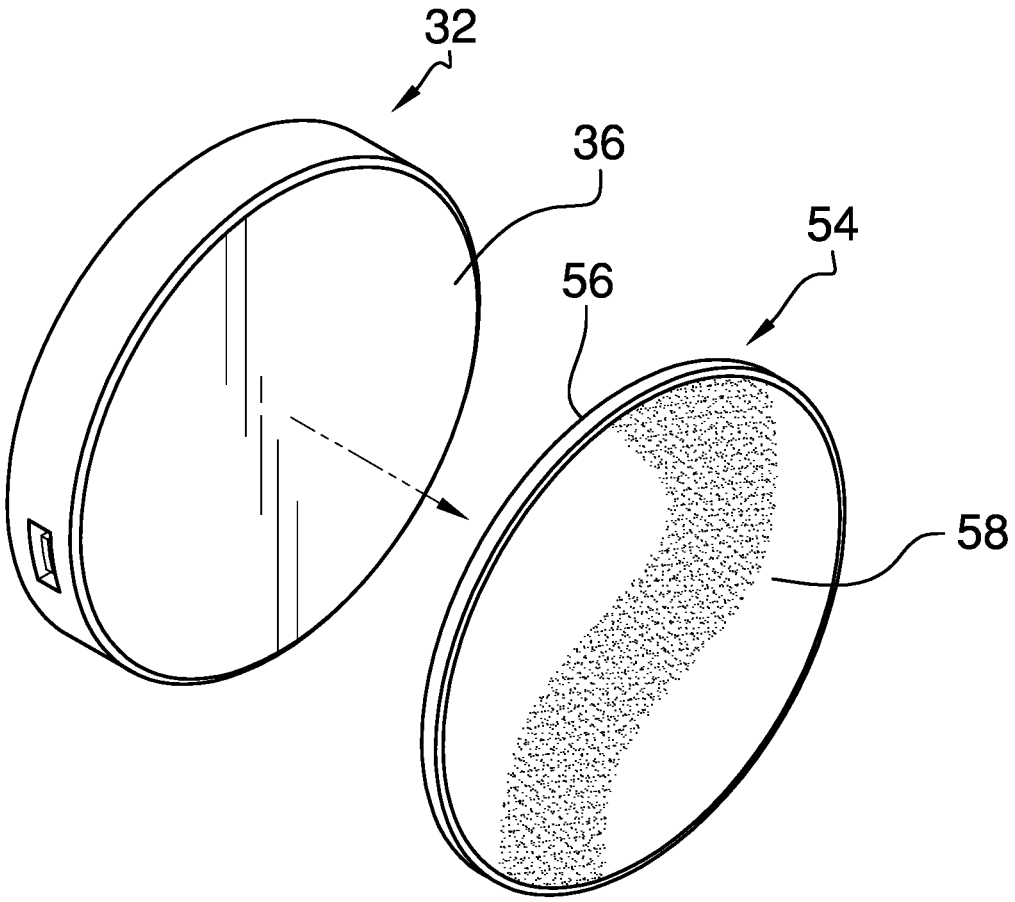
FIG. 6 is a rear isometric view of an embodiment of the disclosure.

With reference now to the drawings, and in particular to FIGS. 1 through 6 thereof, a new availability indicating device embodying the principles and concepts of an embodiment of the disclosure and generally designated by the reference numeral 10 will be described.

As best illustrated in FIGS. 1 through 6, the event indicating light assembly and method 10 generally comprises a software application 12 configured for being programmed on an electronic device 14. The electronic device 14 includes a mobile device 16 and a personal computer 18. The software application 12 is stored within a thumb drive 20. The thumb drive 20 is a universal serial bus flash drive configured for engaging with a universal serial bus input of the personal computer 18 of the electronic device 14. The thumb drive 20 has a light 22 configured for illuminating when the thumb drive 20 is engaged with. The software application 12 is configured for being in communication with a variety of software calendars 24 and for tracking a plurality of events 26 of a user 28 from the variety of software calendars 24. The software application 12 has a plurality of commands 30 wherein each of the commands 30 is configured for inputting data into the software application 12.

A pair of light fixtures 32 is configured for being in wireless communication with the electronic device 14 wherein each of the light fixtures 32 is controlled by the software application 12. Each of the light fixtures 32 has a peripheral surface 34 and a mounting surface 36. Additionally, each of the light fixtures 32 has a perimeter surface 38. The peripheral surface 34 of each of the light fixtures 32 has a plurality of light emitting diodes 40 wherein each of the light emitting diodes 40 is configured for being a respective one of a variety of colors 42. The mounting surface 36 of each of the light fixtures 32 is a metal configured for being magnetic.

A microprocessor 44 is positioned within each of the light fixtures 32. The microprocessor 44 is configured for rendering data and performing actions of the event indicating light assembly 10. The microprocessor 44 is in electric communication with the plurality of light emitting diodes 40 of each light fixture 32. Furthermore, the microprocessor 44 has a transceiver 46 being configured for being in wireless communication with the software application 12 of the electronic device 14. Additionally, a battery 48 is positioned within each of the light fixtures 32 and is in electric communication with the microprocessor 44. The battery 48 is configured for supplying electric power to each light fixture 32. The battery 48 is rechargeable and is in electric communication with a charging port 50 positioned on the perimeter surface of the light fixture 32. The charging port 50 configured for being a universal serial bus port. The charging port 50 is configured for engaging with a charging cord 52 to receive electric power. The charging port 50 of each light fixture 32 can also engage with the thumb drive to communicate each of the light fixtures 32 with the software application 12.

A mounting pad 54 of each of the light fixtures 32 is configured for retaining to a wall 60. The mounting pad 54 has a magnetic surface 56 and an adhesive surface 58. The magnetic surface 56 is magnetic wherein retaining the mounting pad 54 to the metal of the mounting surface 36 of each of the light fixtures 32 by a magnetic force. Alternately, the adhesive surface 58 is configured for adhering to the wall 60 wherein retaining each of the light fixtures 32 in a fixed position upon the wall 60.

In use, the user 28 programs the software application 12 on the electronic device 14. The user 28 communicates the software application 12 with the variety of software calendars 24 of the electronic device 14 wherein obtaining data of the plurality of events 26 of the user 28. The user 28 positions the pair of light fixtures 32 proximate to a respective one of a pair of sides of the wall 60 of a door way 62. Each of the light fixtures 32 is adhered by the mounting pad 54 to a respective one of each of the sides of the wall 60 of the door way 62. The user 28 charges the battery 48 of each of the light fixtures 32 by engaging the charging cord 52 with a charging port 50 of each of the light fixtures 32. The user 28 connects the software application 12 of the electronic device 14 to the transceiver 46 of the microprocessor 44 of each of the light fixtures 32 by wireless communication. Subsequently, the user 28 assigns the plurality of light emitting diodes of each of the light fixtures 32 to a respective one of the plurality of events 26 of the variety of software calendars 24 using the software application 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An event indicating light assembly configured for emitting a variety of colors respective to a variety of events of a software calendar, the event indicating light assembly comprising:

a software application being configured for being programmed on an electronic device, the electronic device including a mobile device and a personal computer, the software application being configured for being in communication with a variety of software calendars, the software application being configured for tracking a plurality of events of a user from the variety of software calendars;

a pair of light fixtures being configured for being in wireless communication with the electronic device, each of the light fixtures having a peripheral surface and a mounting surface, the peripheral surface of each of the light fixtures having a plurality of light emitting diodes, each of the light emitting diodes being configured for being a respective one of a variety of colors;

a microprocessor being positioned within each of the light fixtures, the microprocessor being in electric communication with the plurality of light emitting diodes of each light fixture;

a battery being positioned within each of the light fixtures, the battery being in electric communication with the microprocessor, the battery being in electric communication with a charging port; and a mounting pad of each of the tight fixtures being configured for retaining to a wall.

2. The event indicating light assembly of claim 1, further comprising the software application being stored within a thumb drive, the thumb drive being a universal serial bus flash drive configured for engaging with a universal serial bus input of the electronic device, the thumb drive having a light.

3. The event indicating light assembly of claim 2, further comprising the software application having a plurality of commands, each of the commands being configured for inputting data into the software application.

4. The event indicating light assembly of claim 3, further comprising each of the light fixtures having a perimeter surface.

5. The event indicating light assembly of claim 4, further comprising the microprocessor being configured for rendering data and performing actions of the event indicating light assembly.

6. The event indicating light assembly of claim 5, further comprising the microprocessor having a transceiver, the transceiver being configured for being in wireless communication with the software application of the electronic device.

7. The event indicating light assembly of claim 6, further comprising the battery being configured for supplying electric power to each light fixture, the battery being rechargeable.

8. The event indicating light assembly of claim 7, further comprising the charging port being positioned on the perimeter surface of the light fixture, the charging port configured for being a universal serial bus port.

9. The event indicating light assembly of claim 1, further comprising the mounting surface of each of the light fixtures being a metal, the metal of the mounting surface being configured for being magnetic.

10. The event indicating light assembly of claim 9, further comprising the mounting pad having a magnetic surface and an adhesive surface, the magnetic surface being magnetic wherein being retained to the metal of the mounting surface of each of the light fixtures by a magnetic force, the adhesive surface being configured for adhering to the wall wherein retaining each of the light fixtures in a fixed position upon the wall.

11. An event indicating light assembly configured for emitting a variety of colors respective to a variety of events of a software calendar, the event indicating light assembly comprising:

a software application being configured for being programmed on an electronic device, the electronic device including a mobile device and a personal computer, the software application being stored within a thumb drive, the thumb drive being a universal serial bus flash drive configured for engaging with a universal serial bus input of the electronic device, the thumb drive having a light, the software application being configured for being in communication with a variety of software calendars, the software application being configured for tracking a plurality of events of a user from the variety of software calendars, the software application having a plurality of commands, each of the commands being configured for inputting data into the software application;

a pair of light fixtures being configured for being in wireless communication with the electronic device, each of the light fixtures having a peripheral surface and a mounting surface, each of the light fixtures having a perimeter surface, the peripheral surface of each of the light fixtures having a plurality of light emitting diodes, each of the light emitting diodes being configured for being a respective one of a variety of colors, the mounting surface of each of each light fixture being a metal, the metal of the mounting surface being configured for being magnetic;

a microprocessor being positioned within each of the light fixtures, the microprocessor being configured for rendering data and performing actions of the event indicating light assembly, the microprocessor being in electric communication with the plurality of light emitting diodes of each light fixture, the microprocessor having a transceiver, the transceiver being configured for being in wireless communication with the software application of the electronic device;

a battery being positioned within each of the light fixtures, the battery being in electric communication with the microprocessor, the battery being configured for supplying electric power to each light fixture, the battery being rechargeable, the battery being in electric communication with a charging port, the charging port being positioned on the perimeter surface of the light fixture, the charging port configured for being a universal serial bus port; and a mounting pad of each of the light fixtures being configured for retaining to a wall, the mounting pad having a magnetic surface and an adhesive surface, the magnetic surface being magnetic wherein being retained to the metal of the mounting surface of each of the tight fixtures by a magnetic force, the adhesive surface being configured for adhering to the wall wherein retaining each of the light fixtures in a fixed position upon the wall.

* * * * *